United States Patent [19]

Pallmann

[11] Patent Number: 4,784,198

[45] Date of Patent: Nov. 15, 1988

[54] PROCESS AND APPARATUS FOR LOADING CHIPPING MACHINES WITH LUMBER OF UNIFORM LENGTH

[75] Inventor: Wilhelm Pallmann, Zweibruecken, Fed. Rep. of Germany

[73] Assignee: Pallmann Machinenfabrik GmbH & Co. KG, Zweibruecken, Fed. Rep. of Germany

[21] Appl. No.: 35,766

[22] Filed: Apr. 8, 1987

[30] Foreign Application Priority Data

Apr. 9, 1986 [DE] Fed. Rep. of Germany ..... 3611866

[51] Int. Cl.[4] ..... B27L 11/00

[52] U.S. Cl. ..... 144/373; 144/172; 144/176; 144/180; 144/242 R; 144/356; 414/48

[58] Field of Search ..... 414/417, 48; 144/162 R, 144/163, 176, 172, 180, 242 R, 364, 356, 373; 241/92

[56] References Cited

U.S. PATENT DOCUMENTS 2,712,842 7/1955 Fahrni ..... 241/92
3,863,848 2/1975 Mashuda ..... 241/92
3,913,643 10/1975 Lambert ..... 144/172

*Primary Examiner*—W. Donald Bray
*Attorney, Agent, or Firm*—Foley & Lardner, Schwartz, Jeffery, Schwaab, Mack, Blumenthal & Evans

[57] ABSTRACT

This invention relates to a process and an apparatus for achieving cost-effective and loss-free chipping of lumber which is supplied in lengths of the customary transportation width of approximately 2.50 m. According to the invention, the process comprises a loading operation in which a feed compartment which opens into a chipping space is loaded from above with a compact, aligned lumber pile and then a feed thrust acts directly on the lumber pile to cyclically load it into a chipping unit. The cyclic feed of the lumber pile continues with pieces of lumber of equal length being loaded while a pile for the next load is formed into another compact, aligned lumber pile. An apparatus comprises a loading magazine with pivotable load flaps forming a V-shaped bottom and arranged above a trough and a thrust plate longitudinally displaceable in a controllable manner to thrust lumber into a chipping compartment.

17 Claims, 2 Drawing Sheets

1
2
3
4
5
6
9
9'
10
12
14
15
16
19
20
L
L1
II
II
a0=b+c
a1
a2
a3
an
b
c
s

PROCESS AND APPARATUS FOR LOADING CHIPPING MACHINES WITH LUMBER OF UNIFORM LENGTH

FIELD OF THE INVENTION

The invention relates to a process for loading chipping machines for the generation of high-grade flat chips by cost-effective, loss-free chipping of lumber of approximately equal length, and to an apparatus for implementation of the process.

BACKGROUND OF THE INVENTION

Lumber, in particular round timber, which is intended for the generation of high-grade chips, is frequently supplied to the processing plants in lengths which are equivalent to the maximum allowable loading width of the transportation vehicles, in other words between about 2.40 m and 2.60 m long. As there are design limits to the working width of chipping machines, until now there have been virtually only two possibilities of chipping pieces of lumber of this length, that is, either by sectional chipping in so-called long log chipping machines or by previously cutting to length the pieces of lumber to match the working width of the chipping machine in question.

The first processing possibility, the sectional chipping of pieces of lumber sized to approximately the maximum allowable loading width of vehicles, can admittedly be carried out on longtimber chipping machines, on which the pieces of lumber ere cyclically fed to the chipping machine in a feeder channel provided with a conveyor belt, but considerable disadvantages have to be accepted in this operation. For instance, pieces of lumber of this relatively short length tend to lie at an angle in the long feeder channel, which not only has a disruptive effect on the chipping operation, but also impairs the degree of filling of the feed channel and so the qualitative and the quantitative capabilities of the chipping machine are unfavorable. With pieces of lumber of this length, there are consequently not only spaces at the sides in the feed channel, but also numerous gaps in the longitudinal direction as a result of the random succession of the pieces of lumber, something which not only reduces the fullness of the chipping space but also has the further disadvantage that after each chipping cycle there are a number of residual sections which drop into the empty chipping chamber during the next feed cycle and lie there unchecked in an unfavorable position for chipping. Although attempts have previously been made to counter this problem by the arrangement of a so-called displaceable baffle, this too cannot wholly prevent the occurrence of residual sections, which, if they are very narrow, (i.e., disk-shaped), and are therefore no longer caught by the pressure elements in the chipping space, can impair the quality of the chips generated quite considerably.

The second possibility of chipping pieces of lumber of this conventional transportation length is to divide them in advance into lengths which correspond to the depth of the chipping space or the working width of the chipping unit. This cutting to length of the lumber to match the working width of the cutter rotor in question is an absolute necessity in the case of disk-type chipping machines; it has, however, also already been proposed, as evidenced by U.S. Pat. No. 3,913,643, to use chipping machines with cylindrical cutter rotors. The cutting to length of the pieces of lumber has, however, the great disadvantage that the additional operating stage required for this demands a considerable structural and operational outlay and, additionally, results in a not inconsiderable loss in lumber of about 3%.

SUMMARY OF THE INVENTION

In view of all this, the present invention is based on the object of completely chipping the pieces of lumber supplied in the conventional transportation length of about 2.5 m directly, in other words, without previous processing, in a cost-effective way without having to accept losses of lumber or reductions in quality of the chips generated.

In accordance with the invention, a process and an apparatus for chipping wood is provided. The process comprises aligning a number of substantially equal sized pieces of lumber in a hopper disposed above a feed compartment, depositing the aligned lumber pile into a trough which feeds into a compartment where the chipping occurs and then cyclically advancing the lumber pile into the compartment after each previously advanced portion of lumber has been chipped. The lumber is advanced by means of a thrust plate acting against one end of the lumber pile and the thrust plate is controlled to advance the pile forward by an amount substantially equal to the working width of the chipping compartment. When the thrust plate reaches a predetermined point at which the lumber pile has been nearly completely advanced into the chipping compartment, the plate is retracted and another aligned lumber pile is fed into the trough.

An apparatus in accordance with the present invention comprises a hopper, a trough, a thrust plate and a chipping machine. In one preferred embodiment, the hopper has a V-shaped bottom comprising two pivoting flaps which pivot outwardly to deposit the lumber pile into the trough. Each pivoting flap can be pivoted by a hydraulic cylinder piston hinged to its underside. In another preferred embodiment, the flaps are concave or convex in correspondence with the concave or convex configuration of the trough.

Accordingly, it is an object of the invention to provide a process for thorougly chipping pieces of lumber without extensive handling of the lumber before chipping.

It is also an object of the invention to provide an apparatus for thoroughly chipping pieces of lumber while minimizing the preparation of the lumber for chipping.

It is a further object of the invention to provide an apparatus for automatically and repeatedly loading the chipping compartment of a chipping unit with a maximum amount of lumber.

It is still a further object of the invention to provide an apparatus for chipping wood having a hopper which delivers an aligned pile of lumber to a feed trough.

It is yet a further object of the invention to provide a process and apparatus for economically chipping lumber of a maximum transportation length of between 2.4 and 2.6 meters.

It is yet a further object of the invention to provide a process and apparatus which minimizes the percentage of processed lumber which cannot be chipped.

BRIEF DESCRIPTION OF THE DRAWINGS

Preferred embodiments of the invention are illustrated by way of example in the drawings, in which.

DETAILED DESCRIPTION OF THE PREFERRED EMBODIMENTS

Figure 1:
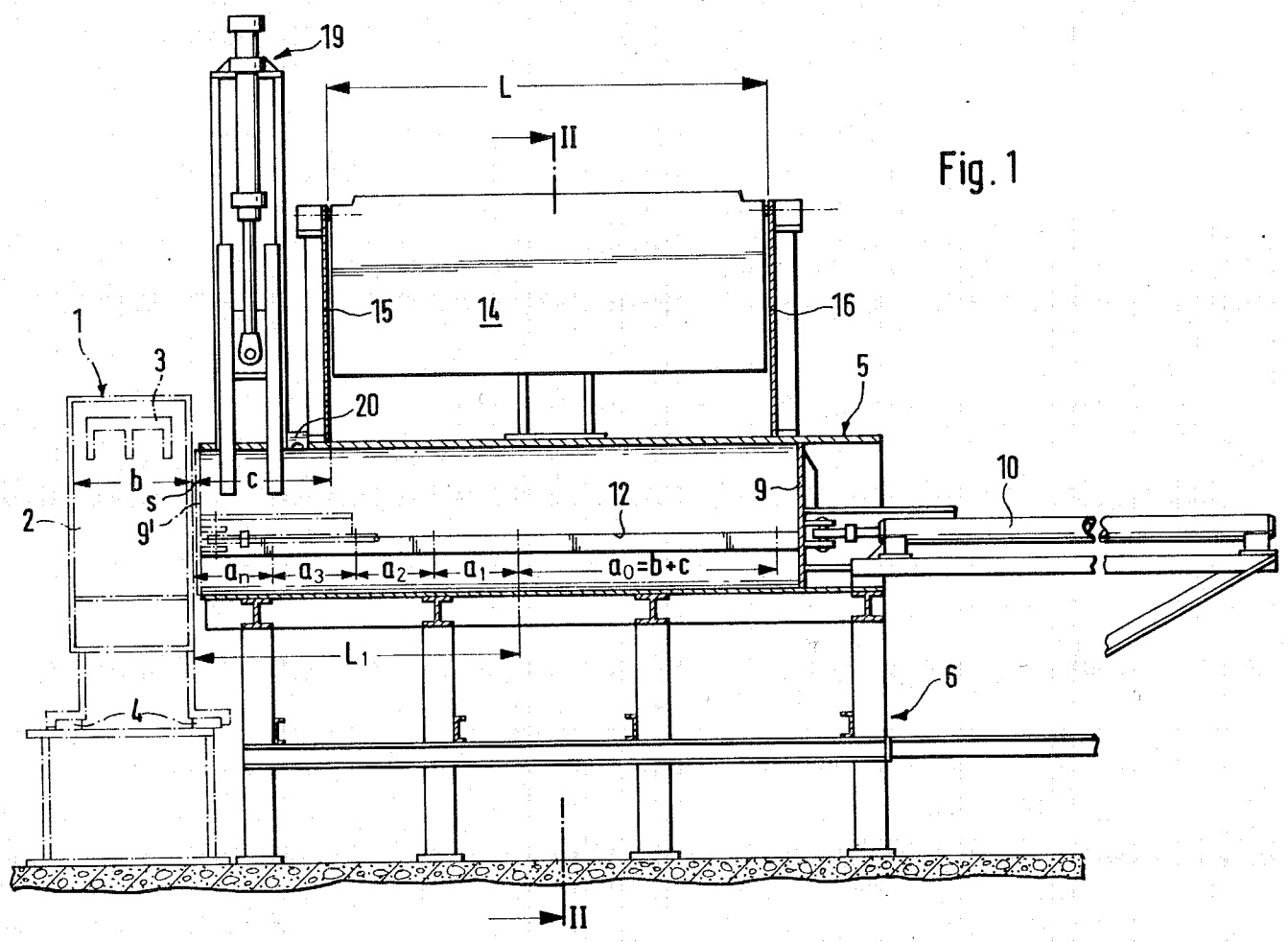
FIG. 1 shows a longitudinal section through a loading apparatus along line I—I in FIG. 2.

The process and apparatus of the present invention are directed to providing cost-effective loading and use of a wood chipping machine. With regard first to the process, the first process step is the loading of the feed compartment is carried out from above, preferably by free fall, in the form of a compact, axially aligned lumber pile. Owing to the mutual support of the pieces of lumber during the loading operation, there is no possibility whatsoever of their changing their mutual positions and thus being laid at an angle in the feed compartment. They therefore retain their axial alignment, adopted in the preceding compacting of the lumber pile with some assistance by the operating personnel.

Since, according to the second process step, the feed thrust acts directly and evenly on all pieces of lumber of the pile, no relative movements between the individual pieces of lumber can occur during the cyclic feed of the lumber pile in the feed compartment, as is the case, for example, with a conveying channel equipped with conveyor belt.

The third process step, according to which the cyclic feed of the lumber pile is divided into sections of equal length matched to the working width of the chipping unit, assures a constantly uniform, optimum loading of the chipping space and at the same time prevents the production of residual disks impairing the chip quality. In this way an optimum utilization of the chipping unit with optimum chip quality is guaranteed.

Finally, the fourth process step, according to which the lumber pile for the next load is compacted and suitably aligned for chipping while chipping is in progress, reduces the idle times of the chipping unit and thereby increases the cost-effectiveness considerably.

As the individual pieces of lumber may vary somewhat in length, it is advantageous if the division of the cyclic lumber feed in sections of equal length is carried out in each case only after the first chipping cycle which sizes the pieces at their front ends.

An apparatus particularly suitable for implementation of the process described above is provided by the invention. In a loading magazine arranged over a trough and provided with pivotal load flaps, the pieces of lumber delivered are packed together into a compact lumber pile by the V-shaped magazine bottom formed by the two load flaps and at the same time are aligned in the longitudinal direction, possibly with the assistance of the operating personnel. By sudden opening of the load flaps, this compact lumber pile, suitably aligned for chipping, then drops into the trough. There the thrust plate which is slidingly guided in the trough, acts directly and evenly on the rear ends of the pieces of lumber. At the same time, the thrust plate also makes possible an exact control of the cyclic lumber feed in loading sections of equal length based on the working width of the chipping unit. Finally, the loading magazine can be refilled during chipping and made ready for the next loading of the trough suitably prepared for chipping.

With regard now to the embodiments shown in the drawings, the chipping unit 1 indicated in FIG. 1 has a chipping space 2 with pressure elements 3 arranged therein. The chipping unit 1, equipped with a customary cylindrical cutter rotor (not shown), is movable back and forth perpendicular to the plane of the figure on a sliding guide 4, the unit chipping whatever lumber there may be in its chipping space 2 when it moves in one direction and reopening the chipping space 2 for the next loading cycle at high speed when it moves in the other direction.

Arranged upstream of the chipping unit 1 on a frame 6 is a trough 5, which is flush with the chipping space 2 and the cross-sectional profile of which corresponds to that of the opened chipping space 2. Consequently, the side walls 7 and 8 of the trough 5 are convexly or concavely curved in cross section corresponding to the radius of the cutter rotor.

In the trough 5 there is a thrust plate 9, which is displaceable along the trough 5 by means of a hydraulic cylinder 10. At the sides, the thrust plate 9 is provided with guide members 11, which slide in guidance grooves 12 which are provided in the side walls 7, 8 of the trough 5. After the first loading stroke $a_0$, the thrust plate 9 is shifted cyclically along sections $a_1, a_2 \ldots a_n$ of equal length, which bear a relation to the depth of the chipping space 2 or the working width b of the chipping unit 1, and to the length of the pieces of lumber, as will be explained below. The end position 9' of the thrust plate 9 is determined by a limit switch and only a very small gap s of about 1 mm in width remains between the cutter rotor of the chipping unit 1 and the front side of the thrust plate 9.

Arranged above the trough 5 is a loading magazine 13, which essentially consists of two pivotable load flaps 14 forming a V-shaped bottom and of two end walls 15 and 16. The front end wall 15 has an axial distance c from the chipping unit 1. A hydraulic cylinder-piston unit 17 serves on each side for actuation of the load flaps 14. A cross-conveyor 18 take care of filling the loading magazine 13. The useful axial length L of the loading magazine 13 corresponds to the maximum allowable loading width of transportation vehicles, in other words L is about 2.60 m.

Arranged immediately upstream of the cutting unit 1 are hydraulically actuated hold-down devices 19. A light-activated shut down device 20 ensures that the entire plant is shut down immediately if the trough 5 is overloaded.

The loading apparatus described operates as follows:

The pieces of lumber 21 conveyed by the cross-conveyor 18 into the loading magazine 13 form there a compact lumber pile 22 owing to the V-shaped cross section profile, at the same time being aligned in the longitudinal direction, possibly with the assistance of the operating personnel. By sudden opening of the load flaps 14, this compact lumber pile 22, suitably aligned for chipping, then drops into the trough 5. There the pieces of lumber 21 build up into a lumber pile 22' filling the cross section of the trough 5 and maintaining their alignment. This pile is then pushed in sections by the thrust plate 9 into the chipping space 2 of the chipping unit 1.

The length of the first loading stroke $a_0$ is equal to the sum of the working width b of the chipping unit 1 and its distance c from the front end wall 15 of the loading magazine 13. The first loading stroke $a_0$ is completed as soon as the longest of the lumber pieces 21, which vary slightly in length, comes into contact with the rear wall of the chipping space 2. As all pieces of lumber 21 progressively come into contact by their rear ends with the thrust plate 9 during the first loading stroke $a_0$, the lumber pile 22' is sized in its rear region. The sizing in the front region then takes place subsequently during the first chipping cycle, which at the same time effects a sizing cut.

From then on, all pieces of lumber 21 have a uniform residual length $L_1$, which is now divided into loading sections $a_1, a_2 \ldots a_n$ of equal length, the length of which must satisfy the requirement that the final section $a_n$ of the lumber pile 22' in the chipping space 2 is still reliably engaged by the pressure elements 3. This division of the residual length $L_1$ into the loading sections of equal length is taken care of by one of more switches, the equal indexing intervals of which are adjustable or programmable corresponding to the ratio of the residual length $L_1$ to the working width b of the cutter rotor.

In the final loading cycle $a_n$, the thrust plate 9 is stopped by a limit switch in its end position 9', in which it is spaced from the cutter rotor by only a small gap s of bout 1 mm. During the final chipping cycle, the hold-down devices 19 are out of operation.

Since the loading magazine 13 is refilled with pieces of lumber 21 during the chipping of the lumber pile 22' in the trough 5, as soon as the thrust plate 9 has returned to its initial position at high speed, it can be loaded again immediately.

Figure 3:
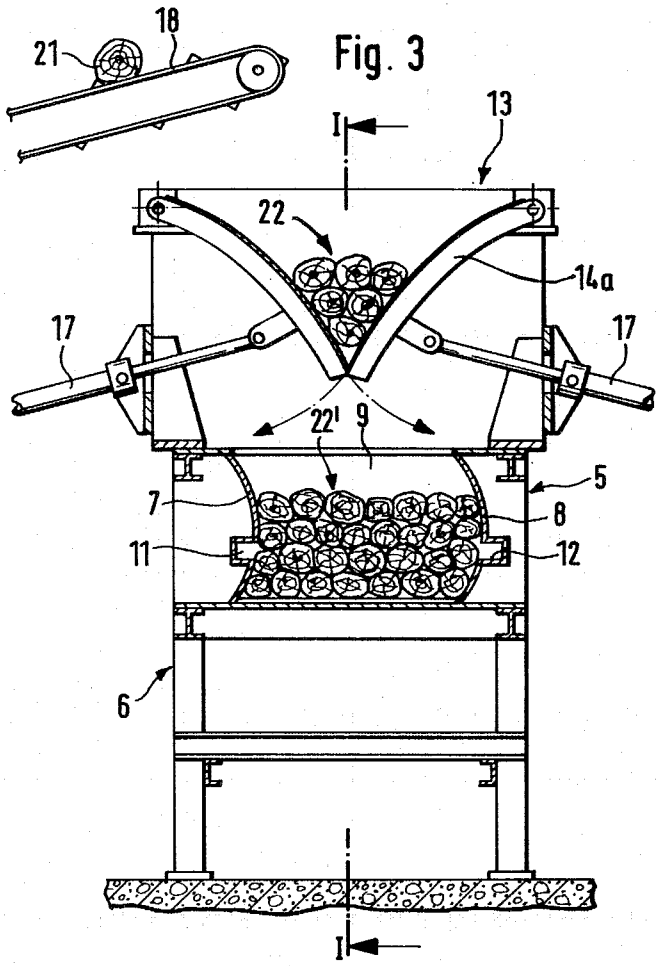
FIG. 3 shows a modified embodiment in the cross section, corresponding to FIG. 2.
Figure 2:
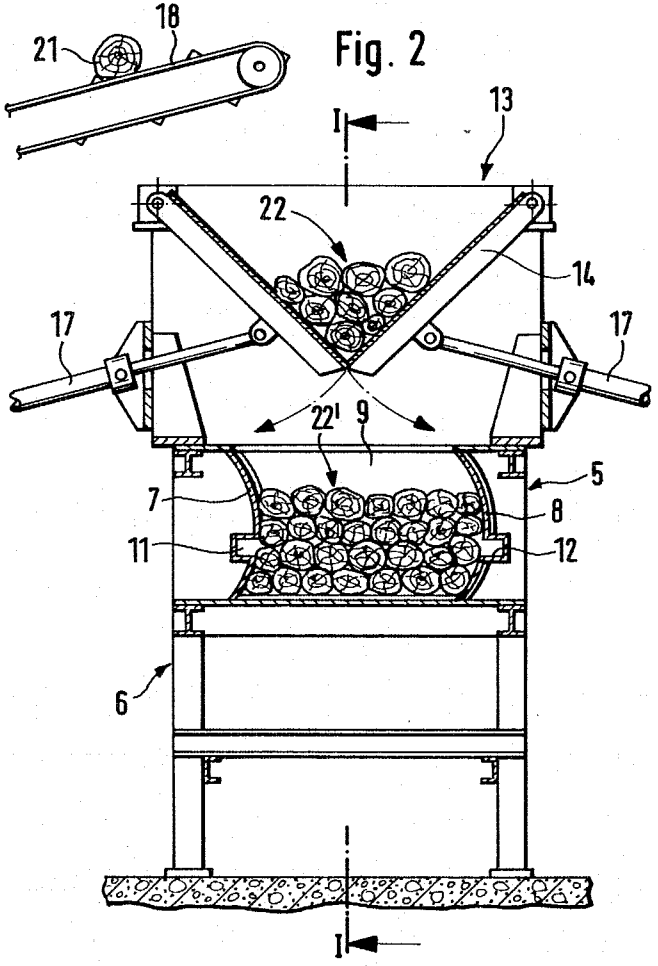
FIG. 2 shows an associated cross section along line II—II in FIG. 1.

As FIG. 2 shows, the load flaps 14 have flat surfaces. FIG. 3 illustrates a modified design with load flaps 14*a*, which are convexly curved in the direction of the inner space of the loading magazine 13 bounded by them. The convex inside surfaces of the load flaps have proven particularly expedient for alignment of the pieces of lumber and for loading of the trough 5.

What is claimed is:

1. A process for loading a wood chipping unit, comprising the steps of:

providing a number of lumber pieces of approximately equal length;

depositing said lumber pieces into a hopper so as to form a compact pile in which said lumber pieces are aligned along their length;

placing said compact pile of lumber pieces into a feed compartment in such a manner that the pile remains substantially aligned;

advancing the lumber pieces of this pile by a plate simultaneously against a chipping unit in a substantially aligned manner;

operating a chipping machine to chip a first portion of said other lengthwise end of said compact pile;

advancing said plate a predetermined length so as to thrust a further portion of said compact pile into said chipping compartment, the length of said further portion bearing a relation to the working width of said chipping compartment and the length of said pile;

operating said chipping machine to chip said further portion;

cycling said plate so as to thrust successive further portions of said compact pile into said chipping compartment after each preceding further portion has been chipped; and depositing the aligning a next set of lumber pieces in said hopper during said propelling of said plate step or said cycling of said plate step.

2. A process according to claim 1, wherein said step of placing said compact pile into a feed compartment comprises dropping said compact pile into said feed compartment.

3. A process according to claim 1, wherein said advancing step and said cycling step are not performed until after said step of operating a chipping machine to chip a first portion of said compact pile.

4. An apparatus for loading a pile of lumber to be chipped in a wood chipping machine, comprising:

(a) a chipping unit for chipping lumber, said unit having an open compartment into which portions of the pile of lumber to be chipped can be inserted;

(b) a conveying assembly including a trough for holding said pile of lumber oriented longitudinally relative to said trough, said trough having side walls and being open at its opposite ends, with one of said ends opening into said open compartment in said chipping unit;

(c) a loading magazine for holding a pile of lumber and delivering said pile into said trough, said magazine being mounted vertically above said trough and containing at least one movable closure member the opening of which permits said pile of lumber to be delivered to said trough;

(d) a thrust plate mounted for longitudinal movement in said trough from said other open end, in which position a pile of lumber can be delivered from said magazine to said trough, to said one open end adjacent said open compartment in said chipping unit, and (e) means for periodically advancing said thrust plate an amount bearing a relation to the length of said pile of lumber and the width of said open compartment, said pile of lumber there being cyclically advanced into said open compartment for chipping by said chipping unit.

5. The apparatus as claimed in claim 4, wherein said thrust plate is stopped in an end position very closely adjacent the entrance to said open compartment thereby to permit the rear ends of said pile of lumber to be fully contained within said compartment for chipping engagement.

6. The apparatus as claimed in claim 4, wherein said loading magazine has a V-shaped bottom.

7. The apparatus as claimed in claim 4, wherein said V-shaped bottom comprises two pivoting flaps the opening of one or both of which permits delivery of said pile of lumber to said trough.

8. The apparatus as claimed in claim 7, wherein said pivoting flaps are convex.

9. The apparatus as claimed in claim 7, wherein said pivoting flaps are concave.

10. The apparatus as claimed in claim 4, wherein said flaps are pivoted open by quick acting actuation mechanisms.

11. The apparatus as claimed in claim 4, wherein said quick acting actuation mechanisms comprise hydraulic cylinder-piston units.

12. The apparatus as claimed in claim 4, further including a cross-conveyor positioned above said loading magazine for delivering pieces of lumber thereto.

13. The apparatus as claimed in claim 4, further comprising a hold-down device located between said loading magazine and said chipping unit for contacting and holding down the pile of lumber in the region adjacent said open compartment.

14. The apparatus as claimed in claim 4, further comprising a light-activated shutdown device for shutting down said machine when said trough is overloaded.

15. The apparatus as claimed in claim 4, further including pressure elements positioned in said open compartment for pressure engagement with the portions of lumber positioned in said open compartment, to enhance chipping.

16. The apparatus as claimed in claim 4, wherein said side walls of said trough are formed with guide grooves and said thrust plate is formed with guide members engagable in said grooves, whereby said thrust plate is guided during longitudinal movement.

17. The apparatus as claimed in claim 16, wherein said side walls of said trough are convexly or concavely curved in cross-section.

* * * * *